US006431269B1

(12) United States Patent
Post et al.

(10) Patent No.: US 6,431,269 B1
(45) Date of Patent: Aug. 13, 2002

(54) ELECTRICALLY CONTROLLED RELEASE DEVICE

(75) Inventors: Roger A. Post, Houston; Dee E. Schrinner, Sugar Land; Peter Howard, Bellville; Gary P. Bickford, Houston, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 09/686,334

(22) Filed: Oct. 11, 2000

(51) Int. Cl.[7] ..... E21B 29/02; E21B 17/00; E21B 23/00

(52) U.S. Cl. ..... 166/65.1; 166/242.7; 166/377

(58) Field of Search ..... 166/65.1, 66, 242.6, 166/242.7, 254.2, 377, 340, 338

(56) References Cited

U.S. PATENT DOCUMENTS 3,327,784 A * 6/1967 Pardue ..... 166/125
4,275,786 A * 6/1981 Lee ..... 166/63
5,323,583 A * 6/1994 Leismer et al. ..... 166/377
5,810,088 A * 9/1998 Lamirand et al. ..... 166/242.6
6,032,733 A 3/2000 Ludwig et al.

* cited by examiner

*Primary Examiner*—David Bagnell
*Assistant Examiner*—Brian Halford
(74) *Attorney, Agent, or Firm*—Wayne I. Kanak; Brigitte L. Jeffery; John J. Ryberg

(57) ABSTRACT

A cable release apparatus includes a housing and latch mounted at one end of the housing. The latch has a central opening and a plurality of projecting members extending into the housing. A releasable connector is mounted inside the housing. An actuator has one end disposed in the central opening in the latch and another end in contact with the releasable connector. The actuator is movable between a first position prior to activation of the releaseable connector and a second position wherein the releasable connector is activated. Prior to activation of the releasable connector, the latch is held in place by an interference fit between the projecting members and the housing. When the releasable connector is activated, the projecting members are deflected by applying tension to the latch, thereby releasing the latch from the housing.

25 Claims, 4 Drawing Sheets

ELECTRICALLY CONTROLLED RELEASE DEVICE

BACKGROUND OF THE INVENTION

1. Field of the Invention

The invention relates to a mechanism for releasing a wireline cable from a cable head.

2. Background Art

In oil and gas wireline operations, downhole tools, e.g., logging tools, are conveyed downhole within a wellbore using a wireline cable. The downhole tools are typically tubular members that are threaded together to form a "tool string." A cable head couples the wireline cable to the tool string. Occasionally, during operation, the tool string may become stuck in the wellbore. When the tool string gets stuck, a high tension is usually applied to the tool string to try to free the tool string from its stuck position. This high tension is applied to the wireline cable at the surface, and the wireline cable transmits the applied tension to the cable head. The cable head in turn transmits the tension to the tool string. The amount of tension available to free the tool string from its stuck position depends on the breaking strength of the wireline cable, the profile and coefficient of friction of the wellbore, the position of the tool string inside the wellbore, and various other parameters, in particular the weight of the cable in the wellbore.

The connection between the cable head and the wireline cable typically includes a "weak point." A weak point is a link designed to break when a predetermined amount of tension is applied to it. Normally, the weak point has the lowest breaking strength in the tensile string. The weak point allows the wireline cable to be separated from the cable head in the event that enough tension cannot be applied to free the tool string. The operator first latches onto the cable head or tool string using a fishing tool coupled to one end of a drill pipe and then applies tension to the wireline cable to break the weak point and release the wireline cable from the cable head. The wireline cable is first removed from the wellbore, and hen the cable head and the tool string are pulled out of the wellbore by removing the drill pipe.

The weak point is usually designed for the worst case scenario. In other words, the breaking strength of the weak point must be lower than the minimum tension that the wireline cable can transmit to the desired maximum depth of descent into the wellbore. Otherwise, if the tool string gets stuck at a depth where the amount of tension that can be transmitted safely through the wireline cable is less than the breaking strength of the weak point, it will be impossible to break the weak point. The strength of the weak point must also be greater than the weight of the tool string plus a safety factor. These requirements sometimes limit the depth to which the tool string can safely descend inside the wellbore.

However, the tool string will not always get stuck at the maximum depth of descent into the wellbore. If the tool string gets stuck at a point above the maximum depth of descent into the wellbore, the maximum tension that can be transmitted to the cable head without breaking the wireline cable will be much greater than what is needed to break the weak point. If this maximum tension is transmitted to the cable head, the weak point will break before the fully available tension can be used to try to free the tool string.

The different tool sticking conditions give rise to the need for a weak point having two distinct breaking strengths. In one mode, the breaking strength of the weak point is greater than the breaking strength of the wireline cable so that all the tension capable of being transmitted to the cable head can be applied to freeing the tool string from its stuck position. In another mode, the weak point can be broken without exceeding the breaking strength of the wireline cable at any depth of descent.

U.S. Pat. No. 6,032,733 issued to Ludwig et al. discloses a latch assembly for releasably connecting a wireline cable to a cable head which operates in two modes. The latch assembly includes an anchor sub keyed within an inner housing. The anchor sub has a tensile strength greater than the safe pull of the wireline, where "safe pull" of the wireline is defined as a tension that does not exceed one-half the breaking strength of the wireline. The anchor sub has a neck portion and a bore extending from the neck portion to the body of the anchor sub. A latch housing is threaded to the neck portion of the anchor sub, and a chamber is defined within the latch housing. A latch shaft extends through the chamber. One end of the latch shaft is coupled to the wireline. The latch shaft has an enlarged portion which divides the chamber into two sub chambers. In the latched position, there is an interference fit between the latch shaft and the latch housing, the upper sub chamber contains a fusible material, and the volume of the lower sub chamber is substantially zero. The latch assembly also includes heaters for heating the fusible material.

During normal operation, the latch assembly couples the wireline to the cable head housing. When it is desired to release the wireline from the cable head, the operator sends a command to a switching circuit which then directs current to the heaters. The heaters, which are in contact with the latch housing, heat the metal of the latch housing, causing the latch housing and the enlarged portion of the latch shaft to expand. The latch housing has a higher coefficient of expansion than the enlarged portion of the latch shaft. Thus, a gap is formed between the latch housing and the enlarged portion of the latch shaft as the latch housing is heated. The heated latch housing also causes the fusible material in the upper chamber to melt. The melted fusible material flows into the lower sub chamber through the gap formed between the latch housing and the enlarged portion of the latch shaft. As the fusible material flows into the lower sub chamber, the tension applied to the latch shaft by the wireline cable causes the latch shaft to move upwardly. This causes the latch shaft to move to the unlatched position.

SUMMARY OF THE INVENTION

In one aspect, the invention relates to a cable release apparatus which comprises a housing and a latch mounted at one end of the housing. The latch has a central opening and a plurality of projecting members extending into the housing. A releasable connector is mounted inside the housing. An actuator has one end disposed in the central opening in the latch and another end in contact with the releasable connector. The actuator is movable between a first position prior to activation of the releasable connector and a second position wherein the releasable connector is activated. Prior to activation of the releasable connector, the latch is held in place by an interference fit between the projecting members and the housing. When the releasable connector is activated, the projecting members are deflected by applying tension to the latch, thereby releasing the latch from the housing.

In some embodiments, the projecting members comprise outer wedged surfaces for engagement with an inner wedged surface on the housing. In some embodiments, the projecting members comprise inner wedged surfaces for engagement with an outer wedged surface on the actuator. In some embodiments, the releasable connector comprises a plurality of connector segments held together by a spring and a heater for heating a solder joint in the spring so as to enable expansion of the spring. In some embodiments, a spring is provided to apply a force on the actuator such that the actuator moves in the direction of the releasable connector when the releasable connector is activated.

In another aspect, the invention relates to a cable head which comprises a head housing and a cable release housing mounted inside the head housing. The cable head further comprises a latch mounted at one end of the cable release housing. The latch has a central opening and a plurality of projecting members extending into the cable release housing. The cable head further comprises a cable connector coupled to the latch. A releasable connector is mounted inside the cable release housing and an actuator has one end disposed in the central opening in the latch and another end in contact with the releasable connector. The actuator is movable between a first position prior to activation of the releasable connector and a second position wherein the releasable connector is activated. Prior to activation of the releasable connector, the latch is held in place by an interference fit between the projecting members and the housing. When the releasable connector is activated, the projecting members are deflected by applying tension to the latch, thereby releasing the latch from the housing.

In another aspect, the invention relates to a logging tool which comprises a head housing and a cable release housing disposed inside the head housing. The cable head further comprises a latch mounted at one end of the cable release housing. The latch has a central opening and a plurality of projecting members extending into the cable release housing. The cable head further comprises a cable connector coupled to the latch. A releasable connector is mounted inside the cable release housing and an actuator has one end disposed in the central opening in the latch and another end in contact with the releasable connector. The actuator is movable between a first position prior to activation of the releasable connector and a second position wherein the releasable connector is activated. A downhole tool is coupled to the head housing and the cable release housing. Prior to activation of the releasable connector, the latch is held in place by an interference fit between the projecting members and the cable release housing. When the releasable connector is activated, the projecting members are deflected by applying tension to the latch.

Other aspects and advantages of the invention will be apparent from the following description and the appended claims.

DETAILED DESCRIPTION OF THE INVENTION

Embodiments of the invention provide an electrically controlled release device for a downhole cable head, e.g., a downhole logging head. The electrically controlled release device has two modes of operation. In the first mode of operation, the electrically controlled release device transmits the tension applied to the cable head by a wireline cable to the downhole tools coupled to the cable head without releasing the wireline cable from the cable head. In the second mode of operation, the electrically controlled device releases the wireline cable from the cable head when a low tension is applied to the cable head. The electrically controlled release device can be activated to release the wireline cable regardless of the tensile load it is transmitting.

Figure 1:
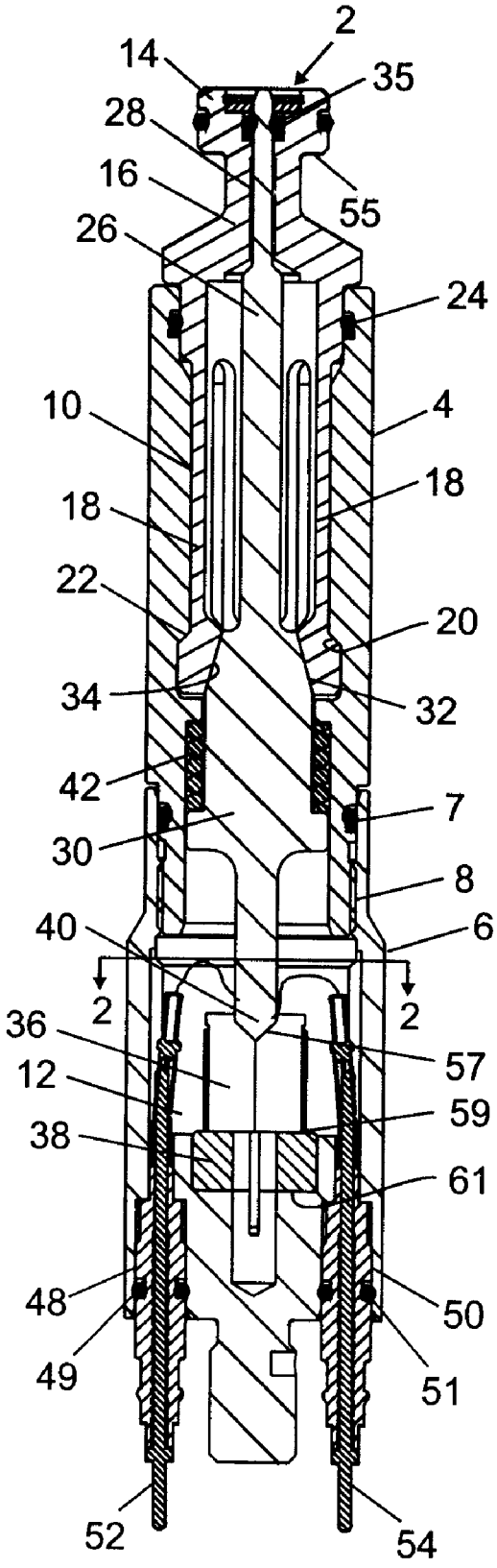
FIG. 1 shows an electrically controlled release device according to an embodiment of the invention.

Various embodiments of the invention will now be described with reference to the accompanying drawings. FIG. 1 shows an electrically controlled release device 2 in accordance with one embodiment of the invention. The release device 2 comprises an upper housing body 4 and a lower housing body 6. The upper housing body 4 is coupled to the lower housing body 6 by a threaded connection 8, for example. An o-ring 7 provides a seal between the upper housing body 4 and the lower housing body 6. The upper housing body 4 is provided with a central opening 10, and the lower housing body 6 is provided with a central chamber 12. A latch 14 is mounted on the upper housing body 4. The latch 14 has a latching head 16 and fingers 18 which extend from the latching head 16. The fingers 18 extend into the central opening 10 in the upper housing body 4. The fingers 18 have wedge-shaped surfaces 20 which are adapted to engage with a wedge-shaped surface 22 in the inner wall of the upper housing body 4. An o-ring 24 provides a seal between the latching head 16 and the upper housing body 4. An actuator 26 is disposed within a central opening 28 in the latch 14. A lower portion 30 of the actuator 26 extends through the upper housing body 4 into the central chamber 12 in the lower housing body 6. The actuator 26 has a tapered surface 32 which engages with tapered surfaces 34 on the fingers 18. An o-ring 35 provides a seal between the latching head 16 and the actuator 26.

Figure 2:
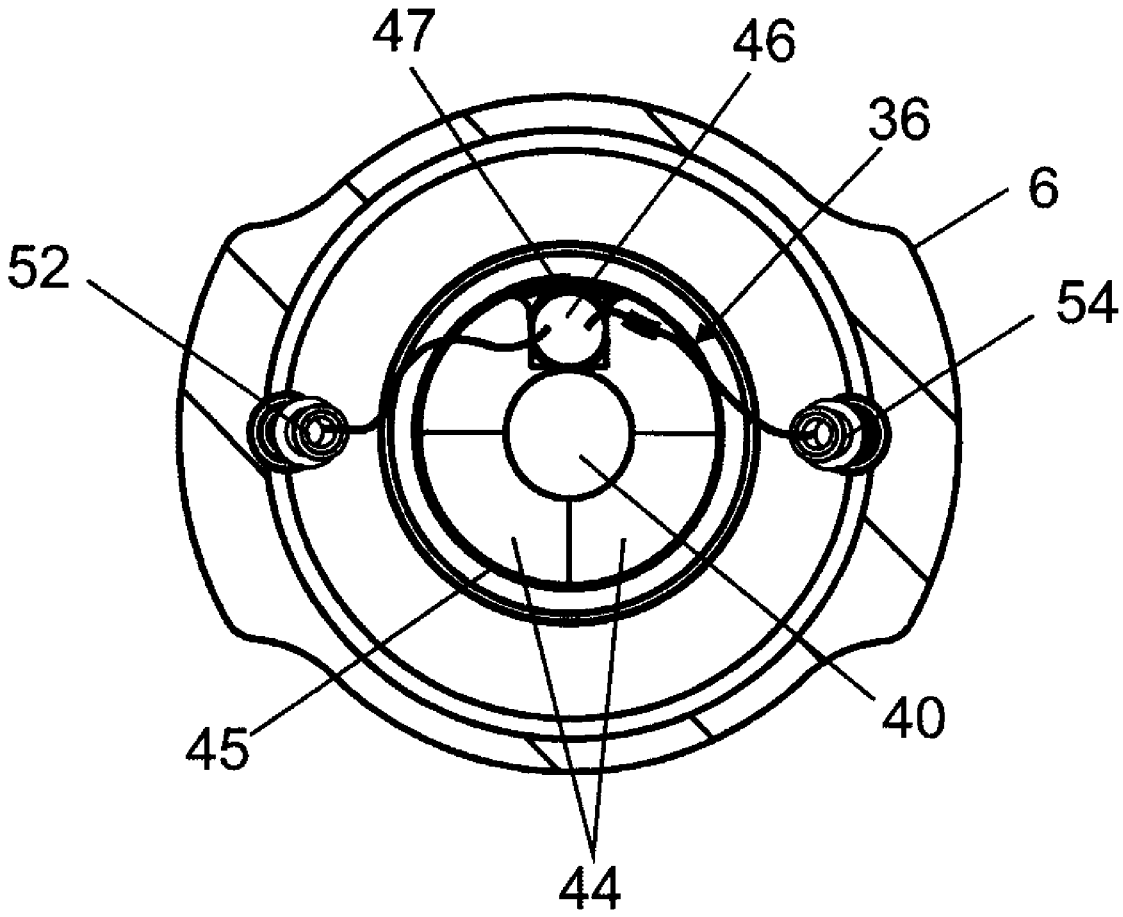
FIG. 2 is a cross-section of the release device of FIG. 1.

A split bobbin assembly 36 is disposed in the central chamber 12 in the lower housing body 6. As shown in FIG. 2, the split bobbin assembly 36 includes quartered bobbin pieces 44 and a resistive heater 46 arranged in a ring structure. The bobbin pieces 44 are preferably made of a heat-resistant material. A metal spring or coil 45 is tightly wound around the bobbin pieces 44 and the resistive heater 46 and soldered in place, as shown at solder joint 47. In this way, the bobbin pieces 44 are held together. In one embodiment, the metal spring 45 is made of a heat-resistant conductive material such as beryllium-nickel alloy. As will be further discussed below, the purpose of the resistive heater 46 is to melt the solder joint 47 so that the metal spring 45 expands. When the metal spring 45 expands, the bobbin pieces 44 become separated.

Returning to FIG. 1, the lower housing body 6 includes two apertures 48, 50 for receiving insulating electrical feed-throughs 52, 54, respectively. 0-rings 49, 51 provide seals between the lower housing body 6, and feed throughs 52, 54 respectively. The electrical feed-throughs 52, 54 provide the electrical current needed to power the resistive heater 46 (shown in FIG. 2). A plate 38 made of insulating material is arranged between the split bobbin assembly 36 and the lower housing body 6. A nose portion 40 of the actuator 26 is in contact with the split bobbin assembly 36. A spring 42 disposed between the actuator 26 and the upper housing body 4 applies a biasing force to the actuator 26 such that the nose portion 40 of the actuator 26 is held against the bobbin pieces 44 (shown in FIG. 2) in the split bobbin assembly 36.

The release device 2 has two modes of operation. In mode one, the release device transmits tension applied to the latch 14 without the fingers 18 separating from the upper housing body 4. In mode two, the fingers 18 can be separated from the upper housing body 4 with a small tension applied to the latch 14. In mode one, a tensile load may be applied to the latch 14 through the surface 55 of the latch 14. The tension applied to the latch 14 is transmitted to the upper housing body 4 through the surfaces 20, 22. The wedging effect of the surfaces 20, 22 tends to cause the fingers 18 to deflect, causing a compressive force to be applied to the actuator 26 through the surfaces 32, 34. The wedging effect created by the interface of the fingers 18 and the actuator 26 at surfaces 32, 34 tends to push the actuator 26 against the split bobbin assembly 36, causing a compressive load at the interface 57 between the nose portion 40 of the actuator 26 and the split bobbin assembly 36. The split bobbin assembly 36 in turn applies a compressive load to the insulating plate 38, and the insulating plate 38 in turn applies a compressive load to the lower housing body 6 through interface 61.

The lower housing body 6 is coupled to the upper housing body 4 such that a compressive load is reacted from the fingers 18 through surfaces 20, 22, through surfaces 32, 34, through the interface 57 between the actuator 26 and the split bobbin assembly 36, through the interface 59 between the split bobbin assembly 36 and the insulating plate 38, and through the interface 61 between the insulating plate 38 and the lower housing body 6. As long as the compressive loop is reacted, the fingers 18 cannot deflect, and they are held in place relative to the upper housing body 4 via an interference fit. Thus, a tensile load can be transmitted from the fingers 18 to the upper housing body 4 without separating the fingers 18 from the upper housing body 4. The tensile load transmitted to the upper housing 4 is then transmitted to the lower housing body 6 through the connection 8 between the upper housing body 4 and the lower housing body 6.

In mode one, the bobbin pieces 44 (shown in FIG. 2) are held together by the metal spring 45 and the fingers 18 are held in place relative to the upper housing body 4. In mode two, the fingers 18 can be separated from the upper housing body 4 with a small tension applied to the latch 14. To switch the release device 2 from mode one to mode two, a command is sent to a switching circuit (not shown) to power the resistive heater 46 (shown in FIG. 2). The switching circuit (not shown) directs current to the resistive heater 46 (shown in FIG. 2) through the electrical feed-throughs 52, 54. The resistive heater 46 (shown in FIG. 2) melts the solder joint 47 in the metal spring 45, as previously described, thus allowing the metal spring 45 to expand and the bobbin pieces 44 to become separated. When the bobbin pieces 44 separate, the actuator 26 moves downwardly. The force which causes the actuator 26 to move downwardly comes from the spring 42 and the wedging effect between the surfaces 20, 22 and 32, 34 created by the tension applied to the latch 14. In this state, the compressive loop described above can no longer be reacted and a small tension applied to the upper housing body 4 will separate the fingers 18 from the upper housing body 4. Once the fingers 18 are separated from the upper housing body 4, the latch 14 can be removed from the release device 2.

Preferably, the seal provided by 0-ring seal 35 is broken when the bobbin pieces 44 separate and as the actuator 26 moves downwardly. This allows the release device 2 to be flooded with wellbore fluid so that pressure balance is created between the interior and the exterior of the release device 2. This is necessary because the interior of the release device 2 is initially at atmospheric pressure and the release device 2 may need to be separated at ambient external pressures as high as 20,000 psi. If the release device 2 were not pressure balanced, the pressure forces holding the latch 14 and the upper housing body 4 would be too great to allow the fingers 18 to be separated from the upper housing body 4. The flooding of the release device 2 also provides additional force for moving the actuator 26 downwardly. In addition, the wedge shape of the surfaces 32 of the actuator 26 allows the release device 2 to be separated while tension is being transmitted by the release device 2. If the surface 32 were parallel to the axis of the release device 2, frictional forces would keep the actuator 26 from moving while the release device 2 is transmitting tension, even if the bobbin pieces 44 are separated.

Figure 3:
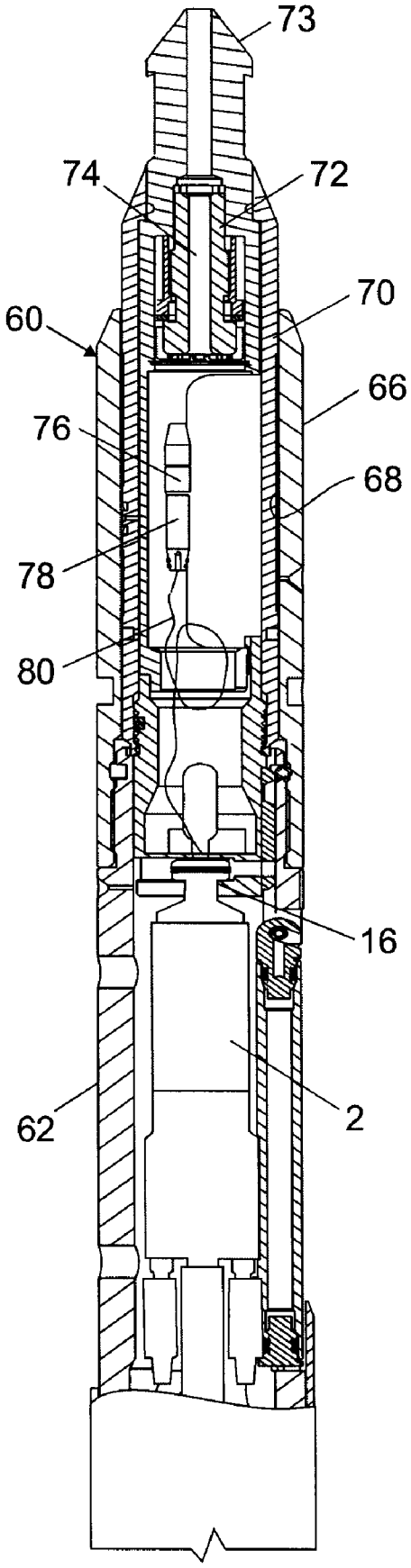
FIG. 3 shows the release device of FIG. 1 located in a logging head.

FIG. 3 shows a well logging cable head 60. It should be noted that the cable head 60 is not shown in its entirety to avoid obscuring the invention. In operation, the lower end of the cable head 60 would be coupled to a logging tool assembly (not shown). The cable head 60 includes an outer housing 62. The electronically controlled release device 2 (previously shown in FIG. 1) is mounted inside the outer housing 62. A fishing neck 66 is mounted at the upper end of the outer housing 62. The fishing neck 66 has a central bore 68 for receiving a shell 70. The lower end of the shell 70 is secured to the latching head 16 of the release device 2. A housing 73 is attached to the upper end of the shell 70. Inside the housing 73 is a rope socket 72 which has an aperture 74 for receiving a wireline cable (not shown). A conductor sleeve 76 is mounted inside the shell 70. The conductor sleeve 76 connects the terminal ends of conductors in the wireline cable (not shown) to a connector 78 in the shell 70. The connector 78 is in turn connected to the rest of the tool by electrical wiring 80. In this way, signals can be transmitted to and from the surface through the wireline cable (not shown).

Figure 4:
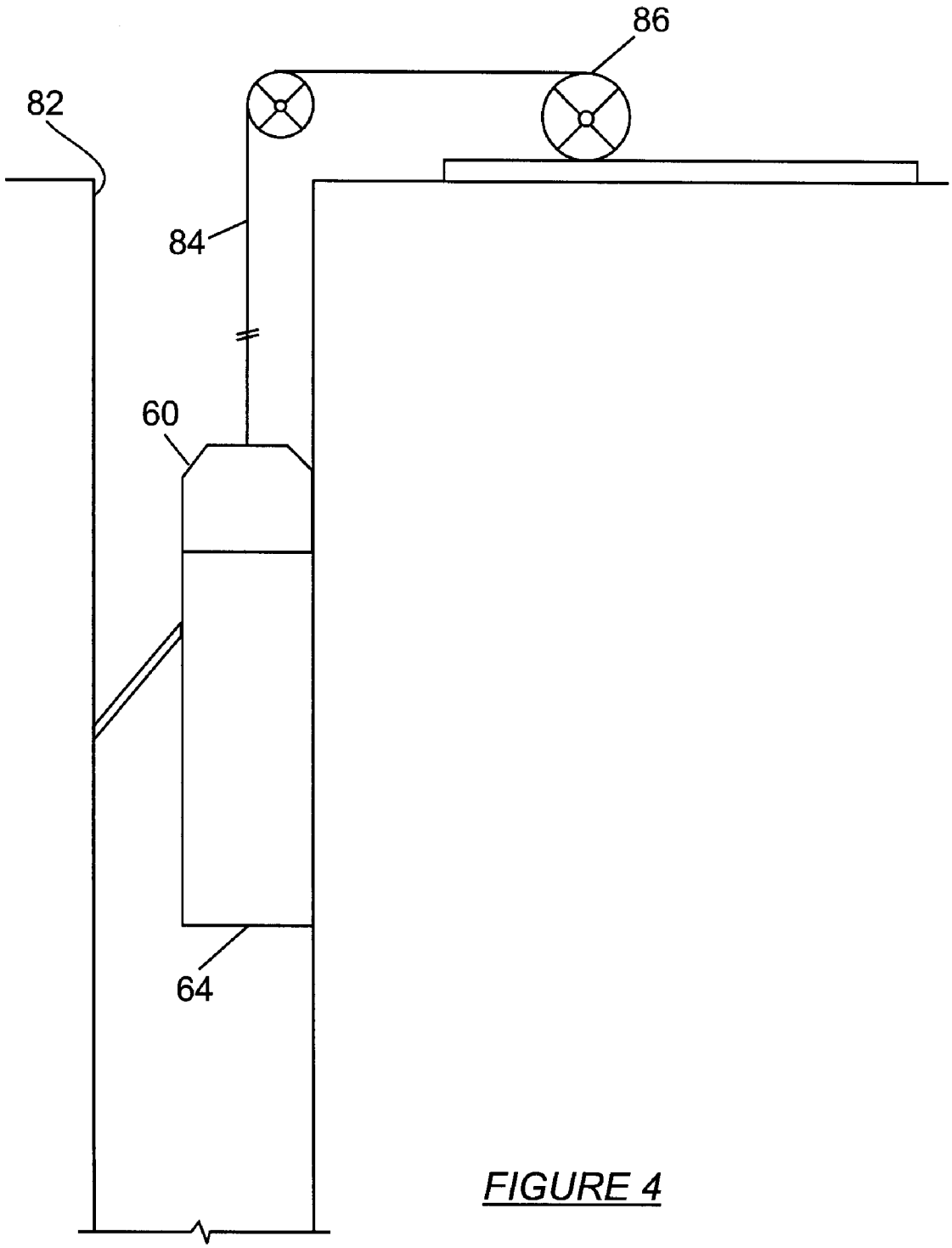
FIG. 4 shows a logging tool suspended in a wellbore on the end. of a wireline cable.

FIG. 4 shows the cable head 60 suspended in a wellbore 82 on the end of a wireline cable 84. The wireline cable 84 is payed from a surface winch 86. In operation, tension from the surface winch 86 is transmitted down to the cable head 60 via the wireline cable 84. The tension transmitted to the cable head 60 is then transmitted to the logging tool assembly 64 attached to the cable head 60 through the release device 2 in the cable head 60 (see FIG. 3). During normal logging, the release device 2 in the cable head 60 (see FIG. 3) is in mode one in which it will transmit high tensions without separating. When desired, the release device 2 in the cable head 60 (see FIG. 3) is actuated to mode two and will separate with only a small tensile force applied to it.

In mode two, the operator first sends a command to the downhole switching circuit (not shown) to power the resistive heater 46 (shown in FIG. 2). The resistive heater 46 (shown in FIG. 2) melts the solder joint 47 in the metal spring 45 (shown in FIG. 2), allowing the bobbin pieces 44 (shown in FIG. 2) to separate. Once the bobbin pieces 44 (shown in FIG. 2) separate, a small tensile force applied to the release device 2 will separate the fingers 18 (shown in FIG. 1) from the upper housing body 4 (shown in FIG. 1). When the fingers 18 (shown in FIG. 1) are separated from the upper housing body 4 (shown in FIG. 1), the latch 14 (shown in FIG. 1) and the other components coupled to the latch 14, e.g., the receiving sleeve 70, can be released from the cable head 60 and pulled to the surface. The rest of the cable head 60 and the logging tool assembly 64 can then be pulled out of the wellbore 82 using a fishing tool (not shown).

The invention is advantageous in that it provides an electronically controlled weak point that will release regardless of the tension it is transmitting. The release device operates in one of two modes. In mode one, the release device will not separate while transmitting tension. In this mode, the weak point is then the wireline cable. In mode two, the release device will separate with a small applied tension. The release device will separate regardless of the tension it is transmitting. The release device can be located in a cable head, as shown in FIG. 3, or in any cable head in general.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cable release apparatus, comprising:

a housing;

a latch mounted at one end of the housing, the latch having a central opening and a plurality of projecting members extending into the housing;

a releasable connector mounted inside the housing; and an actuator disposed in the housing, the actuator having one end disposed in the central opening in the latch and another end in contact with the releasable connector, the actuator being movable between a first position prior to activation of the releasable connector and a second position when the releasable connector is activated;

wherein the projecting members comprise inner wedged surfaces for engagement with an outer wedged surface on the actuator; and wherein prior to activation of the releasable connector, the latch is held in place by an interference fit between the projecting members and the housing, and when the releasable connector is activated, the projecting members are deflected by applying tension to the latch, thereby releasing the latch from the housing.

2. The cable release apparatus of claim 1, wherein the projecting members comprise outer wedged surfaces for engagement with an inner wedged surface on the housing.

3. The cable release apparatus of claim 1, wherein the releasable connector comprises a plurality of connector segments held together by a spring.

4. The cable release apparatus of claim 1, further comprising a seal for sealing between the actuator and the latch.

5. The cable release apparatus of claim 7, wherein the seal between the actuator and the latch is configured to break as the actuator moves from the first position to the second position, thereby exposing the interior of the housing to external pressure when the releasable connector is activated.

6. A cable release apparatus, comprising:

a housing;

a latch mounted at one end of the housing, the latch having a central opening and a plurality of projecting members extending into the housing;

a releasable connector mounted inside the housing; and an actuator disposed in the housing, the actuator having one end disposed in the central opening in the latch and another end in contact with the releasable connector, the actuator being movable between a first position prior to activation of the releasable connector and a second position when the releasable connector is activated;

wherein the releasable connector comprises a plurality of connector segments held together by a spring, and an electrically operated heater for melting a solder joint in the spring so as to enable expansion of the spring; and wherein prior to activation of the releasable connector, the latch is held in place by an interference fit between the projecting members and the housing, and when the releasable connector is activated, the projecting members are deflected by applying tension to the latch, thereby releasing the latch from the housing.

7. A cable release apparatus, comprising:

a housing;

a latch mounted at one end of the housing, the latch having a central opening and a plurality of projecting members extending into the housing;

a releasable connector mounted inside the housing;

an actuator disposed in the housing, the actuator having one end disposed in the central opening in the latch and another end in contact with the releasable connector, the actuator being movable between a first position prior to activation of the releasable connector and a second position when the releasable connector is activated; and a spring for applying a force to the actuator such that the actuator moves in the direction of the releasable connector when the releasable connector is activated; and wherein prior to activation of the releasable connector, the latch is held in place by an interference fit between the projecting members and the housing, and when the releasable connector is activated, the projecting members are deflected by applying tension to the latch, thereby releasing the latch from the housing.

8. A cable release apparatus, comprising:

a housing;

a latch mounted at one end of the housing, the latch having a central opening and a plurality of projecting members extending into the housing;

a seal for sealing between the latch and the housing;

a releasable connector mounted inside the housing; and an actuator disposed in the housing, the actuator having one end disposed in the central opening in the latch and another end in contact with the releasable connector, the actuator being movable between a first position prior to activation of the releasable connector and a second position when the releasable connector is activated;

wherein prior to activation of the releasable connector, the latch is held in place by an interference fit between the projecting members and the housing, and when the releasable connector is activated, the projecting members are deflected by applying tension to the latch, thereby releasing the latch from the housing.

9. A cable release apparatus, comprising:

a housing;

a latch mounted at one end of the housing, the latch having a central opening and a plurality of projecting members extending into the housing;

a releasable connector mounted inside the housing, the releasable connector comprising a plurality of connector segments held together by a spring, and an electrically operated heater for melting a solder joint in the spring so as to enable expansion of the spring; and an actuator disposed in the housing, the actuator having one end disposed in the central opening in the latch and another end in contact with the releasable connector, the actuator being movable between a first position prior to activation of the releasable connector and a second position when the releasable connector is activated;

wherein prior to activation of the releasable connector, the latch is held in place by an interference fit between the projecting members and the housing, and when the releasable connector is activated, the projecting members are deflected by applying tension to the latch, thereby releasing the latch from the housing.

10. A cable head, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing; and an actuator disposed in the cable release housing, the actuator having one end disposed in the central opening in the latch and another end in contact with the releasable connector, the actuator being movable between a first position wherein the releasable connector is not activated and a second position wherein the releasable connector is activated;

wherein the projecting members comprise inner wedged surfaces for engagement with an outer wedged surface on the actuator; and wherein prior to activation of the releasable connector, the latch is held in place by an interference fit between the projecting members and the housing, and when the releasable connector is activated, the projecting members are deflected by applying tension to the latch, thereby releasing the latch from the housing.

11. The cable head of claim 10, wherein the projecting members comprise outer wedged surfaces for engagement with an inner wedged surface on the cable release housing.

12. The cable head of claim 10, wherein the releasable connector comprises a plurality of connector segments held together by a spring.

13. The cable head of claim 10, further comprising a seal for sealing between the actuator and the latch.

14. The cable head of claim 13, wherein the seal between the actuator and the latch is configured to break as the actuator moves from the first position to the second position, thereby exposing the interior of the cable release housing to external pressure when the releasable connector is activated.

15. A cable head, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing and comprising a plurality of connector segments held together by a spring, and an electrically operated heater for heating a solder joint in the spring so as to enable expansion of the spring; and an actuator disposed in the cable release housing, the actuator having one end disposed in the central opening in the latch and another end in contact with the releasable connector, the actuator being movable between a first position wherein the releasable connector is not activated and a second position wherein the releasable connector is activated;

wherein prior to activation of the releasable connector, the latch is held in place by an interference fit between the projecting members and the housing, and when the releasable connector is activated, the projecting members are deflected by applying tension to the latch, thereby releasing the latch from the housing.

16. A cable head, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing;

an actuator disposed in the cable release housing, the actuator having one end disposed in the central opening in the latch and another end in contact with the releasable connector, the actuator being movable between a first position wherein the releasable connector is not activated and a second position wherein the releasable connector is activated; and a spring for applying a force to the actuator such that the actuator moves in the direction of the releasable connector when the releasable connector is activated;

wherein prior to activation of the releasable connector, the latch is held in place by an interference fit between the projecting members and the housing, and when the releasable connector is activated, the projecting members are deflected by applying tension to the latch, thereby releasing the latch from the housing.

17. A cable head, comprising:

a head housing;

a cable release housing disposed inside the head housing;

a latch mounted at one end of the cable release housing, the latch having a central opening and a plurality of projecting members extending into the cable release housing;

a seal for sealing between the latch and the cable release housing;

a cable connector coupled to the latch;

a releasable connector mounted inside the cable release housing; and an actuator disposed in the cable release housing, the actuator having one end disposed in the central opening in the latch and another end in contact with the releasable connector, the actuator being movable between a first position wherein the releasable connector is not activated and a second position wherein the releasable connector is activated;

wherein prior to activation of the releasable connector, the latch is held in place by an interference fit between the projecting members and the housing, and when the releasable connector is activated, the projecting members are deflected by applying tension to the latch, thereby releasing the latch from the housing.

18. A logging tool, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing;

an actuator disposed in the cable release housing, the actuator having one end disposed in the central opening in the latch and another end in contact with the releasable connector, the actuator being movable between a first position wherein the releasable connector is not activated and a second position wherein the releasable connector is activated; and a downhole tool coupled to the head housing and the cable release housing;

wherein the projecting members comprise inner wedged surfaces for engagement with an outer wedged surface on the actuator; and wherein prior to activation of the releasable connector, the latch is held in place by an interference fit between the projecting members and the housing, and when the releasable connector is activated, the projecting members are deflected by applying tension to the latch, thereby releasing the latch from the housing.

19. The logging tool of claim 18, wherein the projecting members comprises outer wedged surfaces for engagement with an inner wedged surface on the cable release housing.

20. The logging tool of claim 18, wherein the releasable connector comprises a plurality of connector segments held together by a spring.

21. The logging tool of claim 18, further comprising a seal for sealing between the actuator and the latch.

22. The logging tool of claim 21, wherein the seal between the actuator and the latch is configured to break as the actuator moves from the first position to the second position, thereby exposing the interior of the cable release housing to external pressure when the releasable connector is activated.

23. A logging tool, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing, the releasable connector comprising a plurality of connector segments held together by a spring, and an electrically operated heater for melting a solder joint in the spring so as to enable expansion of the spring;

an actuator disposed in the cable release housing, the actuator having one end disposed in the central opening in the latch and another end in contact with the releasable connector, the actuator being movable between a first position wherein the releasable connector is not activated and a second position wherein the releasable connector is activated; and a downhole tool coupled to the head housing and the cable release housing;

wherein prior to activation of the releasable connector, the latch is held in place by an interference fit between the projecting members and the housing, and when the releasable connector is activated, the projecting members are deflected by applying tension to the latch, thereby releasing the latch from the housing.

24. A logging tool, comprising:

a head housing;

a cable release housing disposed inside the head housing;

a latch mounted at one end of the cable release housing, the latch having a central opening and a plurality of projecting members extending into the cable release housing;

a cable connector coupled to the latch;

a releasable connector mounted inside the cable release housing;

an actuator disposed in the cable release housing, the actuator having one end disposed in the central opening in the latch and another end in contact with the releasable connector, the actuator being movable between a first position wherein the releasable connector is not activated and a second position wherein the releasable connector is activated;

a spring for applying a force to the actuator such that the actuator moves in the direction of the releasable connector when the releasable connector is activated; and a downhole tool coupled to the head housing and the cable release housing;

wherein prior to activation of the releasable connector, the latch is held in place by an interference fit between the projecting members and the housing, and when the releasable connector is activated, the projecting members are deflected by applying tension to the latch, thereby releasing the latch from the housing.

25. A logging tool, comprising:

a head housing;

a cable release housing disposed inside the head housing;

a latch mounted at one end of the cable release housing, the latch having a central opening and a plurality of projecting members extending into the cable release housing;

a seal for sealing between the latch and the cable release housing;

a cable connector coupled to the latch;

a releasable connector mounted inside the cable release housing;

an actuator disposed in the cable release housing, the actuator having one end disposed in the central opening in the latch and another end in contact with the releasable connector, the actuator being movable between a first position wherein the releasable connector is not activated and a second position wherein the releasable connector is activated; and a downhole tool coupled to the head housing and the cable release housing;

wherein prior to activation of the releasable connector, the latch is held in place by an interference fit between the projecting members and the housing, and when the releasable connector is activated, the projecting members are deflected by applying tension to the latch, thereby releasing the latch from the housing.

* * * * *